US006729758B1

(12) United States Patent
Carter

(10) Patent No.: US 6,729,758 B1
(45) Date of Patent: May 4, 2004

(54) INSULATED CONTAINER FOR KEG BEER

(76) Inventor: James Edward Carter, 213 Corbet St., Tarentum, PA (US) 15084

( * ) Notice: Subject to any disclaimer, the term of this patent is extended or adjusted under 35 U.S.C. 154(b) by 324 days.

(21) Appl. No.: 09/659,792

(22) Filed: Sep. 12, 2000

Related U.S. Application Data

(60) Provisional application No. 60/154,850, filed on Sep. 20, 1999.

(51) Int. Cl.[7] ..... B65D 33/01

(52) U.S. Cl. ..... 383/103; 383/40; 383/110; 220/592.19

(58) Field of Search ..... 383/110, 103, 383/40; 220/903, 592.19, 592.24; 224/148.2, 148.3

(56) References Cited

U.S. PATENT DOCUMENTS

| | | | | | |
|---|---|---|---|---|---|
| 1,632,347 | A | * | 6/1927 | Pipkin | 220/903 X |
| 2,575,893 | A | | 11/1951 | Seaman | |
| 3,443,397 | A | * | 5/1969 | Donovan et al. | 62/398 |
| 3,614,875 | A | * | 10/1971 | McCallun | 383/103 X |
| 4,139,130 | A | * | 2/1979 | Glusker et al. | 224/148.2 |
| 4,468,933 | A | * | 9/1984 | Christopher | 383/110 X |
| 4,759,077 | A | * | 7/1988 | Leslie | 383/18 |
| 4,802,344 | A | * | 2/1989 | Livingston et al. | 62/372 |
| 4,963,175 | A | * | 10/1990 | Pace | 62/372 |
| D316,012 | S | * | 4/1991 | Christopher | D7/605 |
| 5,207,362 | A | * | 5/1993 | Janus et al. | 224/148.3 X |
| 5,251,460 | A | * | 10/1993 | DeMarco et al. | 62/371 |
| 5,564,568 | A | * | 10/1996 | Rankin, Sr. | 220/592.19 X |
| 5,571,260 | A | * | 11/1996 | Krug | 224/148.2 X |
| 5,740,951 | A | * | 4/1998 | Jack | 224/148.3 |
| 5,906,290 | A | * | 5/1999 | Haberkorn | 220/592.19 X |
| 6,082,896 | A | * | 7/2000 | Pulli | 383/110 X |

FOREIGN PATENT DOCUMENTS

| | | | | | |
|---|---|---|---|---|---|
| GB | 2221292 | A | * | 1/1990 | 220/903 |

* cited by examiner

*Primary Examiner*—Jes F. Pascua
(74) *Attorney, Agent, or Firm*—Daniel A. Sullivan Jr.

(57) ABSTRACT

An insulated container for keg beer having at least one of the following improvements: a securement for a spigot of a keg tap, a pocket for beer cups, and an airflow passageway to allow air flow into the container when the keg is removed.

4 Claims, 4 Drawing Sheets

INSULATED CONTAINER FOR KEG BEER

CROSS-REFERENCE TO RELATED APPLICATION

The benefit of provisional application No. 60/154,850 filed Sep. 20, 1999 is claimed. Provisional application No. 60/154,850 filed Sep. 20, 1999 is incorporated here by reference.

BACKGROUND OF THE INVENTION

1. Technical Field

This invention relates to improvements for an insulated container for a beer keg.

2. Background

To keep a keg of beer cold at a picnic or party presents a problem. In the past, the attempted solution to this problem has been to put the keg of beer in a tub filled with ice or a garbage bag filled with ice. This attempted solution is ineffective and messy. Ineffective because the ice melts quickly and a great quantity of ice must be replaced to keep the beer cold. Messy because the melted ice must be emptied from the tub or garbage bag. Often the water leaks out of the garbage bag. This problem has been solved by a removable, insulated container, such as a bag, to cover a keg of cold beer to keep the beer for several hours at the preferred temperature of 36° F. so that picnickers and partygoers can enjoy the beer cold. The expense of ice is eliminated. Handles on the bag provide for ease of transporting the keg, for instance from outside to inside because of rain. The bag is reusable, lightweight, and collapsible, making it easy to store and easily transportable.

SUMMARY OF THE INVENTION

An object of the invention is to provide improvements for insulated bag beer keg containers.

Other objects of the invention will become apparent from the remainder of this specification as set forth below.

An insulated container for keg beer, according to the invention, has at least one of the following improvements: a securement for a spigot of a keg tap, a pocket for beer cups, and an airflow passageway to allow air flow into the container when the keg is removed.

DESCRIPTION OF THE PREFERRED EMBODIMENT

Figure 1:
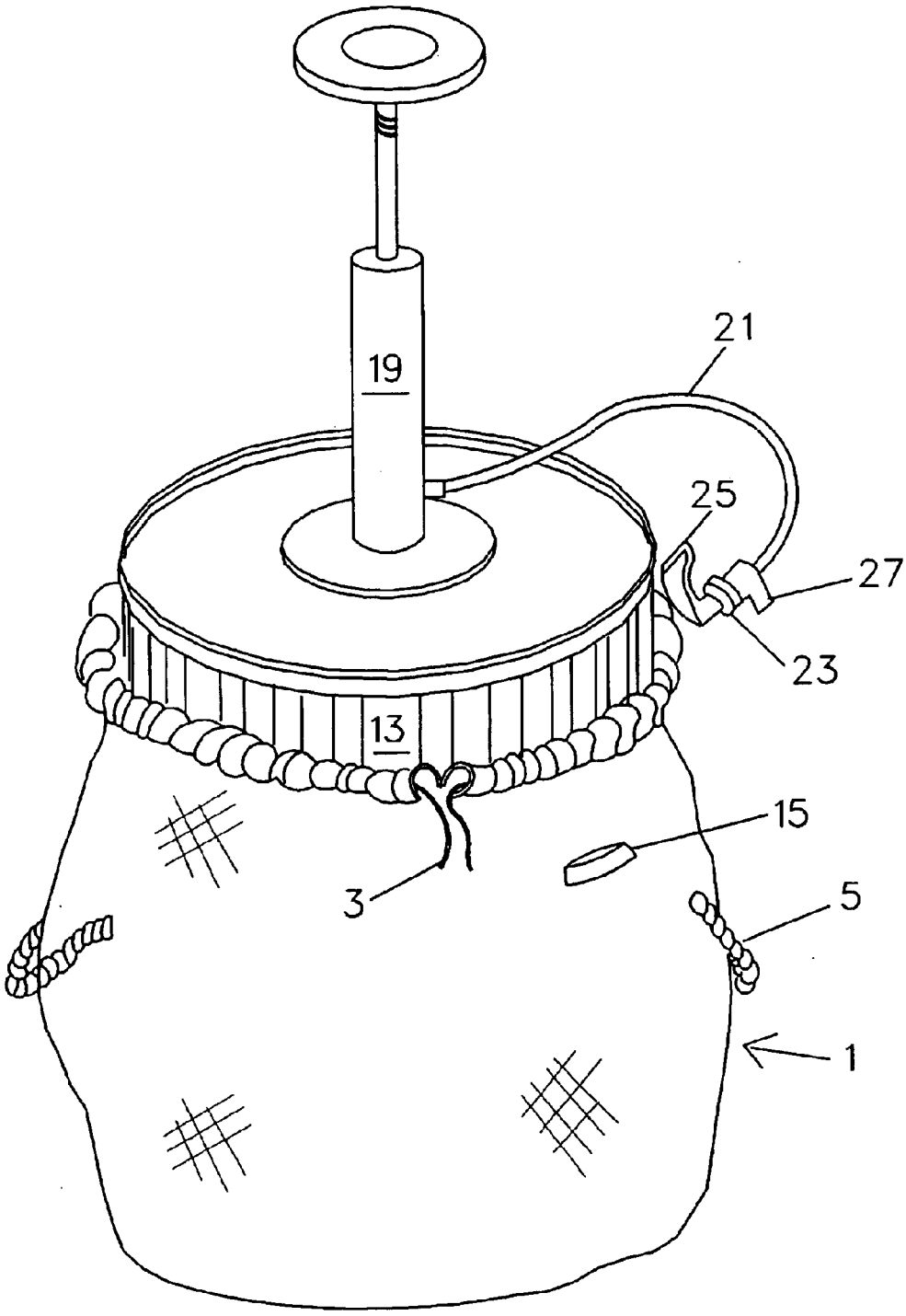
FIG. 1 is a perspective view showing an insulated bag partially covering an unconventional beer keg.

In FIG. 1 of the drawings, preferred embodiments of the invention are illustrated in the context of a flexible, insulated bag 1 for containment of a keg of cold beer. Bag 1 has drawstrings 3 and rope handles 5. The handles 5 may be made of other materials, such as nylon fabric, as well. As shown more discernably in FIG. 3, bag 1 has exterior and interior fabric, outer shell 7 and inner liner 9, of suitable material sandwiching therebetween suitable flexible insulating material 11. A band 15 of suitable fabric, for example the same fabric as that of outer shell 7, is attached to the outside of bag 1, for example, by stitching at its ends, as indicated by the stippling in the drawing; the purpose of band 15 will be explained with reference to FIG. 2.

The material for the exterior and interior fabric may be 430 denier nylon with a ¾ oz. polyurethane coating, heavyweight PVC-coated Dacron, urethane coated nylon, Cordura nylon, Lycra-nylon. The insulating material 11 may be high density 1½" polyurethane foam, Eva foam, open or closed cell foam, Thin-Sulate, Texolite, neoprene, Koflach Alveolite. In an alternate embodiment, outer shell 7 is 200 denier nylon fabric, inner liner 9 is 170 denier, lightweight nylon fabric, and insulating material 11 is 1.5 centimeter thick, flexible, closed cell polypropylene foam insulation.

In FIG. 1, the beer keg 13 is of the unconventional style in that a right circular cylinder is defined by its shape. A keg tap 19, conventionally employed as shown, allows cold beer to be dispensed from beer keg 13 through the flexible beer transmission tube 21 and spigot 23.

Figure 2:
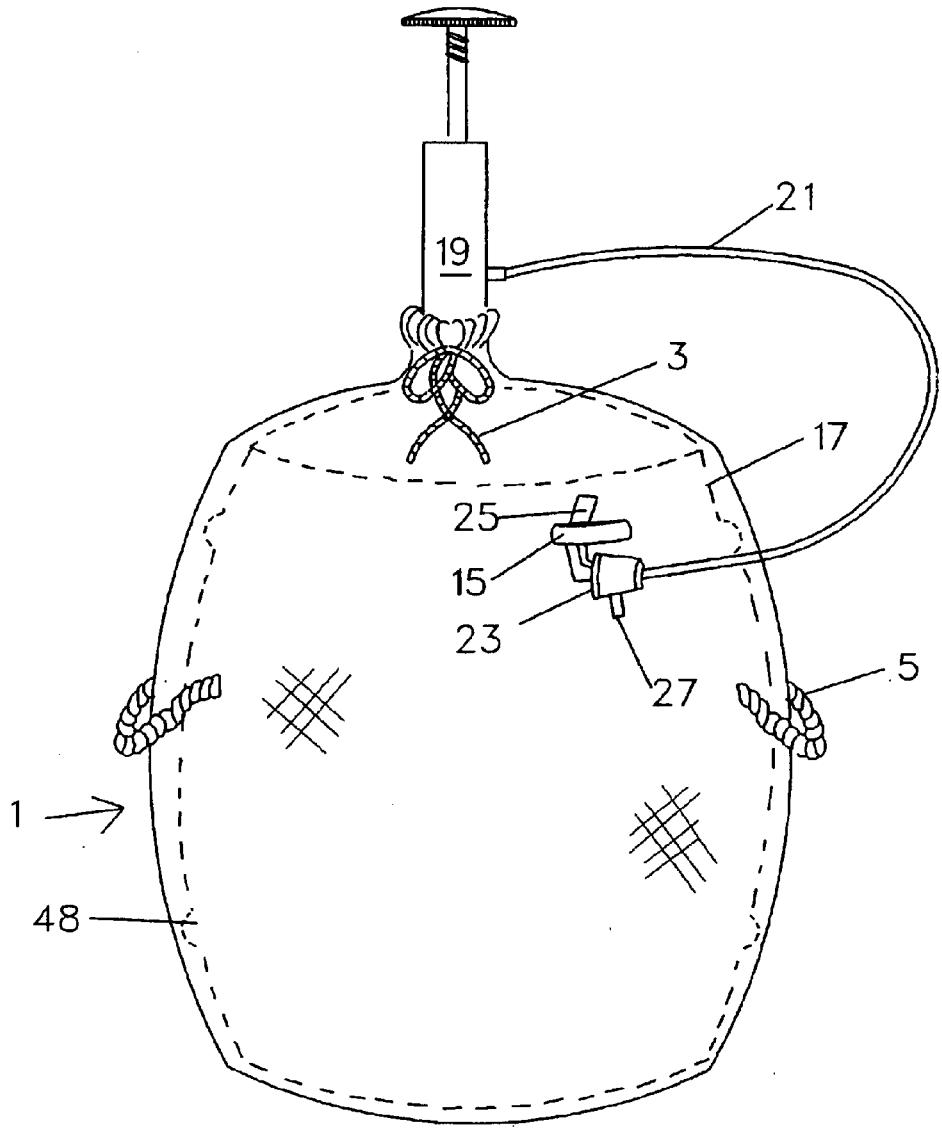
FIG. 2 is a perspective view showing one side of an insulated bag covering a conventional beer keg.
Figure 3:
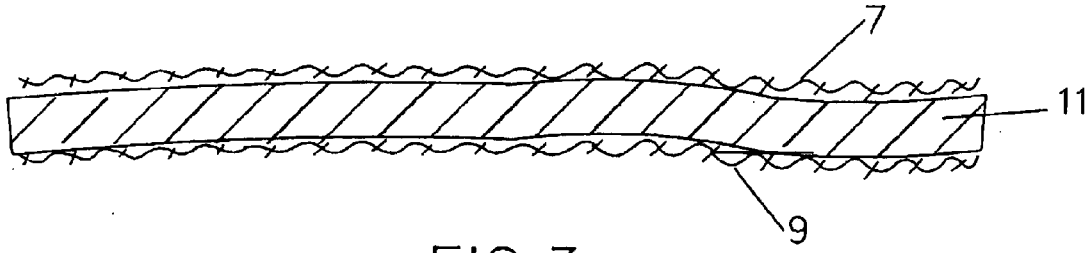
FIG. 3 is a sectional view of a fragmentary portion of the insulated bag showing exterior and interior fabric sandwiching insulating material.

In FIG. 2, the insulated bag 1 is shown covering a conventional style beer keg 17 of ellipsoidal configuration from which cold beer can be dispensed via keg tap 19, with its tube 21 and spigot 23.

FIG. 2 illustrates the purpose of band 15 as a securement for spigot 23. In the illustrated assembly of the spigot with the band, the curved spigot-handle 25, by which the valve in the spigot is operated by thumb pressure on the handle toward tube 21, is maintained hooked into the band by twist on the spigot resulting from the weight of tube 21 and any beer in the tube acting from their combined center of gravity outwards from bag 1. An advantage of the illustrated assembly is that spout 27 is pointing downwards, so that dirt, lint, etc. cannot fall into it. Naturally, it is also possible to reverse the assembly, by placing the handle downwards through the band, rather than upwards as shown.

Figure 4:
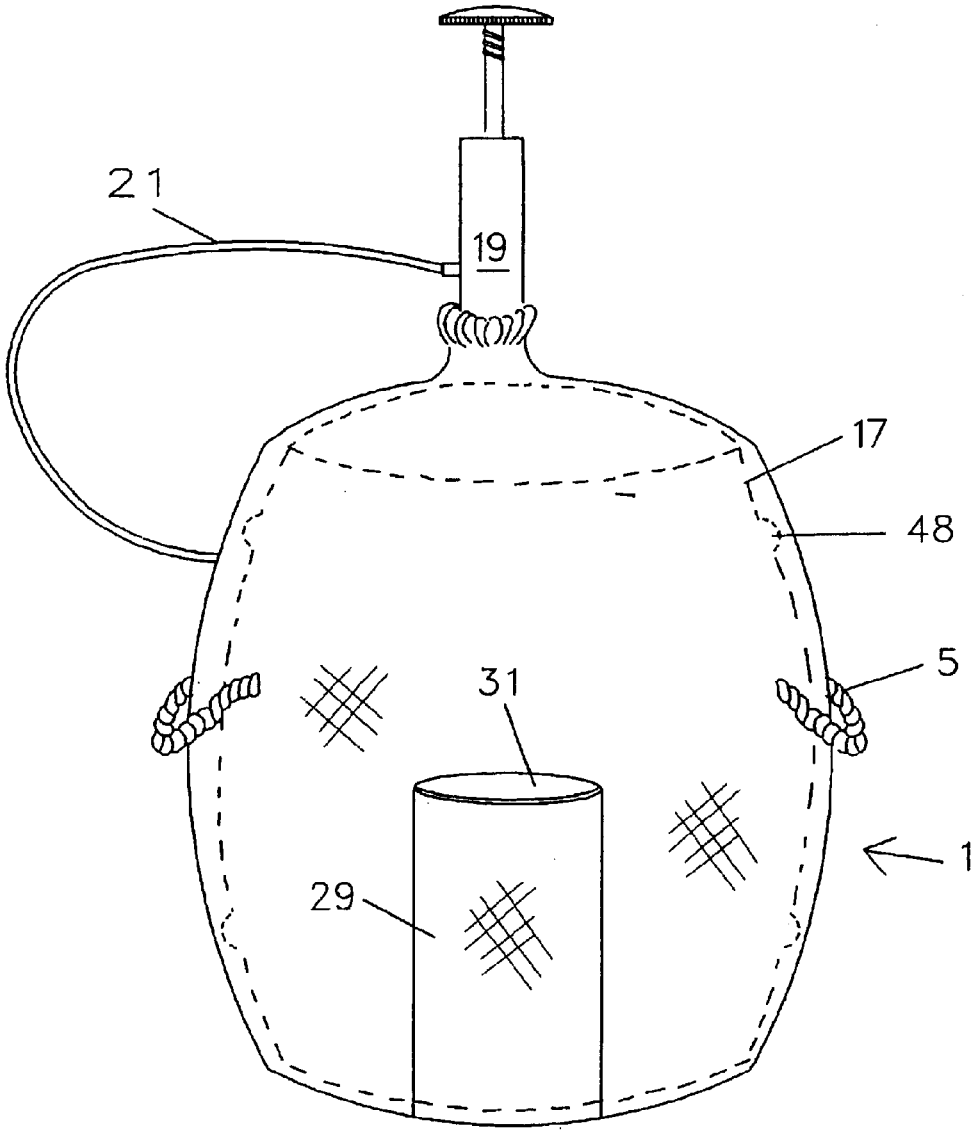
FIG. 4 is a view as in FIG. 2 showing the other side of an insulated bag covering a conventional beer keg.

FIG. 4 shows the opposite side of bag 1 to that shown in FIG. 2. On this other side, a pocket 29, for instance in the form of a collapsible sleeve of the same fabric as the shell, closed at the bottom by panel 29*a* (FIG. 5), is attached, for instance by sewing, to the bag 1 to provide a receptacle for nested, plastic beer cups 31. A fabric awning (not shown), or lid, may be attached to bag 1 above the pocket to keep dirt, lint, etc. from depositing in the cups, and a zipper connection (not shown) may be provided between the bottom edge of the awning and the top edge of the pocket, to close the pocket.

Figure 5:
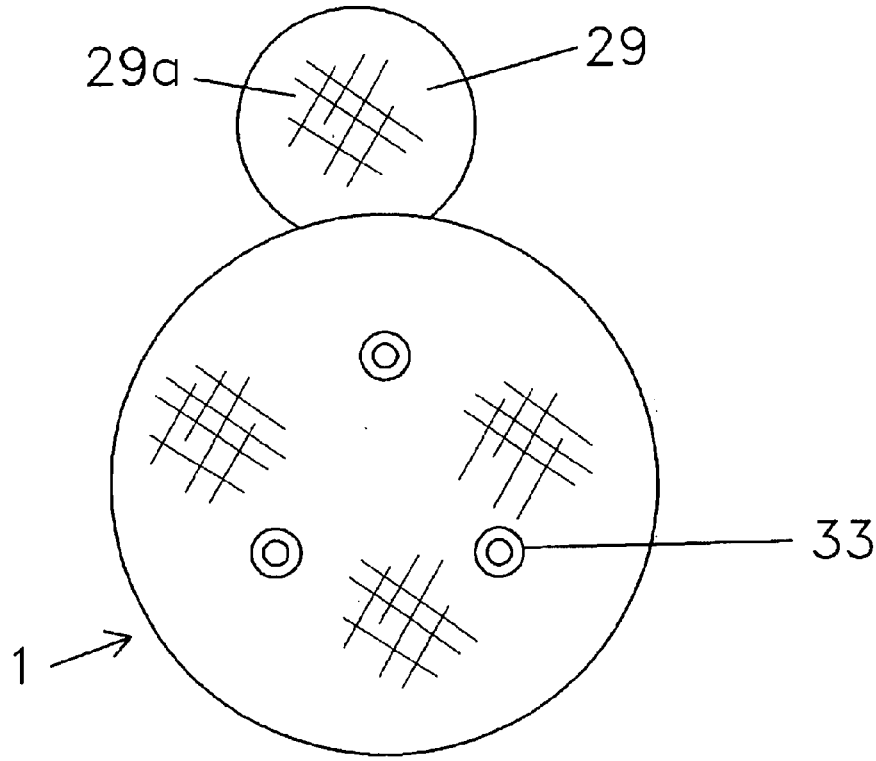
FIG. 5 is a view of the bottom of the bag of FIG. 4.

An additional feature of the invention is an airflow passageway to allow air flow into the container when the keg is removed. Thus, FIG. 5 shows incorporated into the bottom of the bag three 1" grommets 33. These provide holes in the base of the bag to allow air to flow into the bag when the keg is being removed. This prevents a tight fit of the keg in the bag from making it difficult to remove the keg due to a vacuum between the bottom of the keg and the bottom of the bag. The holes are located in the bottom of the bag such that they are essentially sealed, when a beer-containing keg is in the bag, by the pressing of the bottom of the bag by the keg against whatever is supporting the bag, for instance lawn or a cabin floor. This sealing minimizes any heat ingress through the holes.

Although the insulated bag 1 is shown in FIG. 1 as only partially covering beer keg 13, it should be noted that in actual use the rope handles 5 are appropriately grasped and raised upwardly so that bag 1 completely covers beer keg 13 and then the drawstrings 3 are drawn tight to thereby completely cover and insulate beer keg 13 in a fashion similar to beer keg 17.

To facilitate closing with the drawstring, the seat for the drawstring and the top, for example, four inches of the bag may be made of only, for example, the inner liner fabric, attached by sewing to the top edge of the composite of outer shell, insulating material, and inner liner. The composite extends above the keg, so that, upon cinching the drawstring, this top single-layer of fabric folds the upper portion of the composite over, to cover the top of the keg, to provide insulation for the top of the keg.

By means of the insulated bag 1, a consumer can purchase a keg of cold beer and then completely cover the keg with the insulated bag 1, as described, to keep the beer cold for several hours.

By means of the insulated bag 1, the beer distributor can similarly cover a keg of cold beer with the insulated bag 1, keep the beer keg refrigerated and sell the consumer the cold keg of beer that will stay cold for hours.

It is to be understood that the above are merely preferred modes of carrying-out the invention and that various changes and alterations can be made without departing from the spirit and broader aspects of the invention as defined by the claims set forth below and by the range of equivalency allowed by law.

What is claimed is:

1. An insulated container for keg beer, wherein the improvement comprises a securement on the container for a spigot of a keg tap, the securement comprising a band (15) into which a spigot-handle (25) is maintained hooked by twist on the spigot resulting from weight of a spigot tube (21) and any beer in the tube acting from a combined center of gravity outwards from the container, with a spigot spout (27) pointing downwards, the container being a bag, the bag having a hole in a bottom, the hole being located such that a beer-containing keg in the bag can essentially seal the hole by pressing of the bottom of the bag against a support for the bag.

2. An insulated container for keg beer, wherein the improvement comprises a pocket on the container for beer cups, the pocket having a closed bottom, the container being a bag, the bag having a hole in a bottom, the hole being located such that a beer-containing keg in the bag can essentially seal the hole by pressing of the bottom of the bag against a support for the bag.

3. An insulated container for keg beer, wherein the improvement comprises an airflow passageway to allow air flow into the container when the keg is removed, the container being a bag, the airflow passageway comprising a hole in a bottom of the bag, the hole being located such that a beer-containing keg in the bag can essentially seal the hole by pressing of the bottom of the bag against a support for the bag.

4. A method of using an insulated container for keg beer, wherein the improvement comprises a securement on the container for a spigot of a keg tap, the securement comprising a band (15) into which a spigot-handle (25) is maintained hooked by twist on the spigot resulting from weight of a spigot tube (21) and any beer in the tube acting from a combined center of gravity outwards from the container, with a spigot spout (27) pointing downwards, said method comprising placing the handle upwards through the band and maintaining the handle hooked in the band by twist on the spigot resulting from weight of the tube and any beer in the tube acting from a combined center of gravity outwards from the container, with the spout pointing downwards, so that dirt, lint, etc. cannot fall into it.

* * * * *